US006102323A

United States Patent [19]

Riemenschneider

[11] Patent Number: 6,102,323

[45] Date of Patent: Aug. 15, 2000

[54] WEB DISPENSING TOOL

[75] Inventor: Paul Kurt Riemenschneider, Grandville, Mich.

[73] Assignee: Highlight Industries, Inc., Wyoming, Mich.

[21] Appl. No.: 09/222,631

[22] Filed: Dec. 29, 1998

[51] Int. Cl.[7] ..... B65H 23/06

[52] U.S. Cl. ..... 242/422.4; 242/423.1; 242/588.2; 242/597.6

[58] Field of Search ..... 242/422.4, 422.5, 242/588, 588.2, 597.6, 423.1

[56] References Cited

U.S. PATENT DOCUMENTS

| | | | |
|---|---|---|---|
| 4,179,081 | 12/1979 | Parry . | |
| 4,248,392 | 2/1981 | Parry . | |
| 4,530,473 | 7/1985 | Parry . | |
| 4,706,442 | 11/1987 | Riemenschneider . | |
| 4,722,493 | 2/1988 | Parry et al. . | |
| 4,784,348 | 11/1988 | McDonald | 242/422.4 |
| 4,817,762 | 4/1989 | Powell | 242/422.4 X |
| 4,834,312 | 5/1989 | Riemenschneider, III | 242/588.2 |
| 4,872,623 | 10/1989 | Parry et al. . | |
| 5,203,517 | 4/1993 | Parry et al. . | |
| 5,280,869 | 1/1994 | Ricci | 242/588.2 |
| 5,453,152 | 9/1995 | Mazzola et al. | 242/422.4 X |

*Primary Examiner*—Donald P. Walsh
*Assistant Examiner*—William A. Rivera
*Attorney, Agent, or Firm*—Rader, Fishman, Grauer & McGarry, An Office of Rader, Fishman & Grauer PLLC

[57] ABSTRACT

A tool for manually dispensing and applying a web of elongated flexible stock material such as a plastic stretch film from a roll of the stock material having a shaft that supports the roll. The tool includes a flexible gripper having a cylindrically shaped body defining an open center, an open upper end and a closed lower end, and a relatively rigid cylindrical sleeve having a hollow center received in the open center and having a length less than the length of the gripper. This assembly has a gripping surface so that the operator can grip the shaft and hold it tightly without affecting the braking force on the shaft. The operator can compress the upper portion of the gripper inwardly onto the shaft when the gripper and cylindrical sleeve are mounted on the shaft, creating a braking mechanism that slows or stops the rotation of the shaft and at the same time apply a differential pressure to the roll to firmly hold the roll as strongly as necessary.

20 Claims, 1 Drawing Sheet

WEB DISPENSING TOOL

FIELD OF THE INVENTION

This invention relates generally to a toot for dispensing a web. More particularly, the invention relates to tool for manually dispensing and applying a web of elongated flexible stock material, wherein the tool includes a handle and gripper that together form a braking mechanism for controlling the rotation of the shaft supporting the stock material.

BACKGROUND OF THE INVENTION

In shipping and storing goods, a flexible stock material such as a plastic stretch film can be used to protect and secure a load. The advantages of the use of stock materials are numerous. The stock material produces a tight wrap and protects the wrapped load from damage due to weather, abrasions, punctures, and the like.

To utilize the stock material in an optimum manner, the material must be applied to the load at an appropriate tension. If the material is stretched too tight, the material will be difficult to wrap about the load and may break or tear. If the tension in the material is insufficient, the material will not conform to the shape of the load and the material wrap will be undesirably loose.

A number of devices have been developed for controlling the tension applied to the stock material during application of the material to a load. U.S. Pat. Nos. 4,722,493; 4,834,312; 4,872,623 and 5,203,517 show examples of such devices. For instance, U.S. Pat. No. 4,834,312 discloses a device having a head of a size and shape to be forceably inserted into a core. Fixedly projecting from the head is a handle in the form of a spindle. The spindle carries a flexible grip in which the spindle normally freely rotates and which the flexible grip may be selectively squeezed to vary the friction between the grip and the spindle, thus varying the tension in the stock material being applied. Specifically, the grip includes a split cylindrical member telescoped over the spindle. The split cylindrical member may be readily deformed, compressed, by squeezing the same to vary the gripping of the spindle by the split cylindrical member, thus varying the resistance to rotation of the spindle within and relative to the split cylindrical member.

Like U.S. Pat. No. 4,834,312, the remaining above-referenced patents disclose a one-handed device for dispensing a flexible stock material. Each employs a mechanism for varying the tension placed on the material as the material is applied to a load. However, the tension control mechanism for each is located on the gripping portion of the device. Thus, the tension on the material may be increased inadvertently by applying a firm grip to the gripping portion of the device.

Additionally, by placing the tension control mechanism on the gripping surface, there is limited surface area available for gripping the device without affecting the tension applied to the material. Thus, there is a need for a dispensing tool that permits a user to grip the entire handle of the device firmly without affecting the tension placed on the material.

SUMMARY OF THE INVENTION

The present invention relates to a tool for manually dispensing and applying a web of elongated flexible stock material such as a plastic stretch film from a roll of the stock material having a shaft that supports the roll. The tool includes a flexible gripper having a cylindrically shaped body defining an open center, an open upper end and a closed lower end, and a relatively rigid cylindrical sleeve having a hollow center received in the open center and having a length less than the length of the gripper. An operator can compress the upper portion of the gripper inwardly onto the shaft when the gripper and cylindrical sleeve are mounted on the shaft. Pressing the gripper onto the shaft creates a braking mechanism that slows or stops the rotation of the shaft.

To facilitate the compression, the gripper can include a recessed surface that is received in an annular groove defined by the shaft. The inward taper of the recessed surface thus aids pressing the surface into contact with the mating groove. Additionally, the gripper includes an annular ridge for retarding axial movement of the sleeve within the open center, and axially extending ridges for retarding rotational movement of the sleeve within the open center.

Further, according to the invention, a gripper assembly for a tool for manually dispensing and applying a web of elongated flexible stock material from a roll of the stock includes a flexible gripper having a cylindrically shaped body defining an open center, an open upper end and a closed lower end, and a relatively rigid cylindrical sleeve received in the open center and having a length less than the length of the gripper.

BRIEF DESCRIPTION OF THE DRAWINGS

The features and inventive aspects of the present invention will become more apparent upon reading the following detailed description, claims and drawings, of which the following is a brief description:

DESCRIPTION OF THE PREFERRED EMBODIMENT

Figure 1:
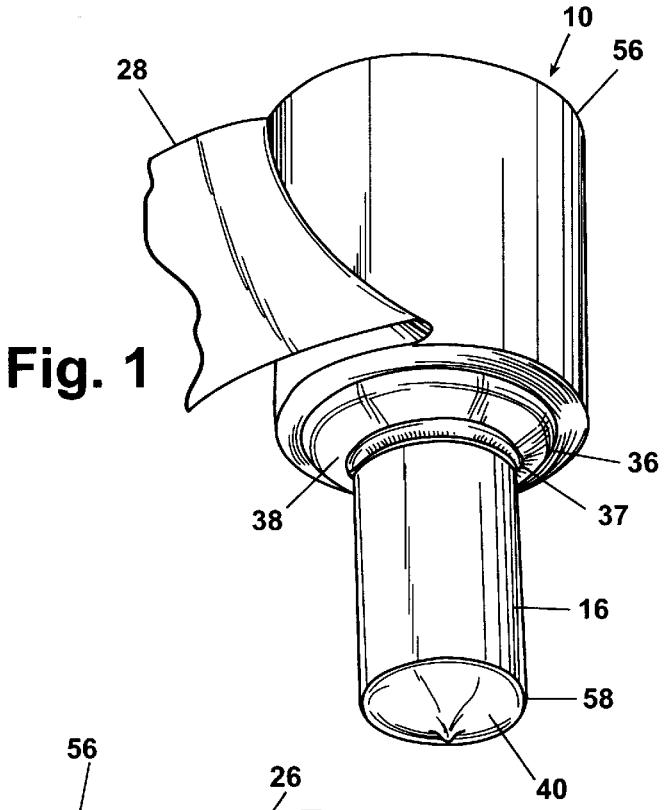
FIG. 1 is a perspective view of a web dispensing tool formed according to the teachings of the present invention.

FIG. 1 shows an embodiment of a dispensing tool 10 formed in accordance with the teachings of this invention. The tool 10 includes a shaft 12, sleeve 14, and gripper 16.

Figure 2:
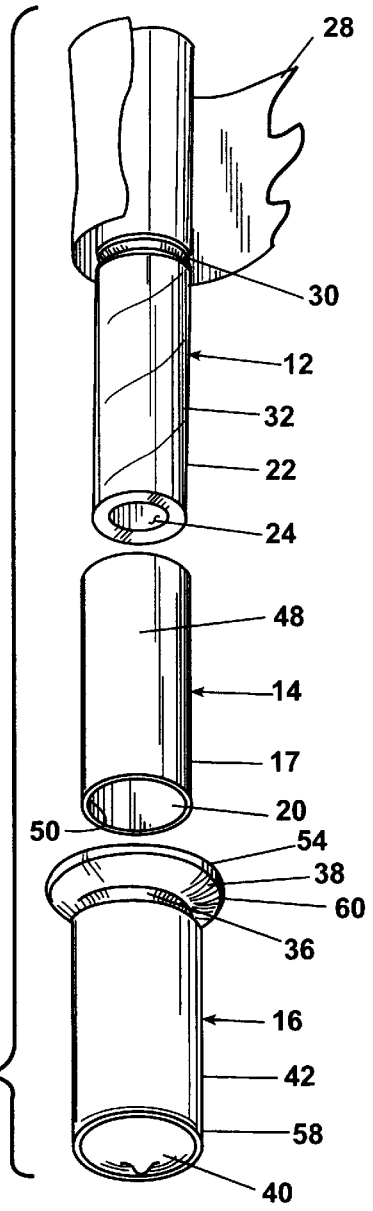
FIG. 2 is an exploded view of the web dispensing tool shown in FIG. 1.

As illustrated in FIG. 2, the shaft 12 includes a cylindrical body 32 surrounding a hollow center 24 and a circumferentially extending groove 30. The groove 30 is located at a central portion of the shaft 12 in close proximity to a roll 28 of stock material. It will be appreciated that the groove 30 may be located at other points along the shaft 12. On one side of the groove 30, the shaft 12 defines an outwardly extending core 26 for supporting a flexible stock material 28 such as a plastic stretch film. On the opposite side of the groove 30, the shaft 12 defines a handle 22 extending in a direction opposite the core 26 for manipulating the tool 10.

The shaft 12 has a rigid construction such that the core 26 does not readily deform or break upon application of bending or compressive forces. The shaft 12 is fabricated of a plurality of concentrically wound layers of a paper or plastic material. The layers of the paper material are bonded together using a suitable adhesive in conventional fashion. Additionally, the paper material has the consistency of paper board material known and used in the industry for cores designed to support paper or plastic products.

The sleeve 14 has a cylindrically shaped body 18 surrounding an open center 20. The cylindrical body 18 includes smooth or textured exterior and interior surfaces 48, 50, respectively. The sleeve 14 is constructed of a relatively rigid material such that the sleeve 14 is not easily compressible, but deforms slightly, without completely collapsing in response to a compressive load. The sleeve 14 can be made from any suitable moldable plastic, preferably a thermoplastic material that has self-lubrication properties, such as polyethylene, polypropylene, ABS, PVC, HDPE and the like. The sleeve 14 is preferably manufactured of PVC. The sleeve 14 can also be made of paperboard.

The gripper 16 provides a support surface for a user's hand during manipulation of the tool 10. The gripper 16 is preferably molded of a soft pliable plastic material such a polyvinyl chloride, polyvinylidene chloride, thermoplastic rubber resins and the like. Preferably, the gripper 16 is molded of PVC. In the event that the shaft is made from plastic material, the gripper 16 can be made of a pliable paperboard.

Figure 3:
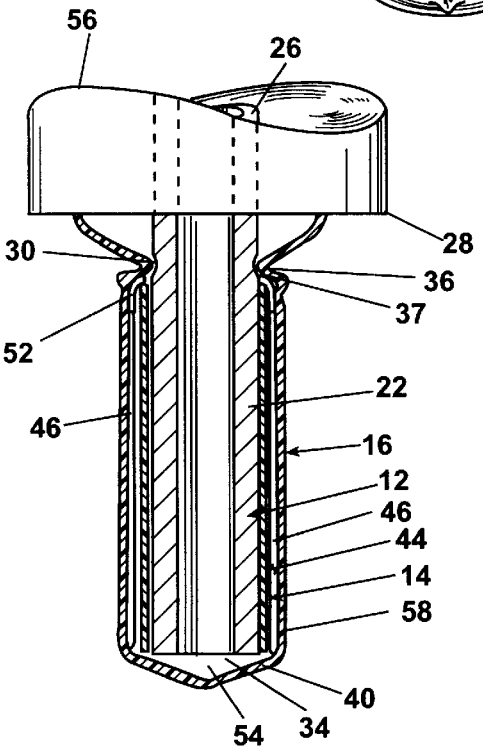
FIG. 3 is a sectional view through the handle and gripper of the web dispensing tool shown in FIG. 1.

The gripper includes a cylindrical body 42 defining an open center 34, as shown in FIG. 3. The open center 34 is closed at one end 58 by an integrally formed cap 40. The opposite end 60 is open. The gripper 16 also includes a recessed portion 36 formed near the open end 60.

The top edge of the recessed portion 36 is contiguous with an outwardly projecting flange 38. The flange 38 extends around the outer periphery of the upper end 58 of the gripper 16, providing a barrier between the bottom portion of the stock material 28 and the user's hand. The flange 38 includes an upwardly extending lip 54 that acts as a bearing surface against which the roll 56 of stock material 28 rotates. The lower edge of the recessed portion 36 adjoins an annular projection 37 having an arcuate in cross section shape and projecting outwardly from the recessed portion 36.

The annular projection 37 supports an inwardly projecting annular ridge 52. The annular ridge 52 extends inwardly from the annular projection 37 in the direction of the open center 34. Additionally, the interior surface 44 of the gripper 16 includes axially extending ridges 46. The ridges 46 protrude inwardly from the interior wall 44 in the direction of the open center 34.

ASSEMBLY

The sleeve 14 is press fit into the open center 34 of the gripper 16, as the outer diameter of the sleeve 14 is slightly larger than the inner diameter of the hollow center 34. Once the sleeve 14 is in place in the open center 34, compressive forces are induced on the exterior surface of the sleeve 14 by the axial ridges 46 and the annular ridge 52. This arrangement creates a frictional lock that retards and prevents axial or rotational movement of the sleeve 14 with respect to the gripper 16.

The sleeve 14 and gripper 16 assembly receives the handle 22 into the hollow center 20 of the sleeve 14. The inner diameter of the hollow center 20 is large enough to permit the handle 22 to rotate freely therein. Once the handle 22 is received in the hollow center 20, the groove 30 receives the recessed portion 36, creating a frictional engagement that retains the gripper 16 on the handle 22. Additionally, the lip 54 abuts the lower portion of the stock material 28, as illustrated in FIG. 3.

OPERATION

In use, the stock material 28 is drawn from a roll 56 wound around the outer periphery of the core 26. The user manipulates the tool 10 by wrapping the thumb and fingers around the outer periphery of the gripper 16, and dispenses the stock material 28 by placing the leading edge of the film 28 on the surface to be covered. The user dispenses the desired amount of film 28 by moving the tool 10 along the surface to be covered, causing the roll 56 to rotate. Once the handle 22 is received in the sleeve 14, the handle 22 rotates freely in the center 20 of sleeve 14 relative to the gripper 16. As a result, the user may apply a firm, tight grip to the gripper 16 without affecting the rotational motion of the handle 22 about the center 20 of sleeve 14.

To slow or stop the rotation of the roll 56, the user simply presses the recessed portion 36 into the groove 30 and presses into adjacent areas. This arrangement creates a braking mechanism that retards the rotational motion of the handle 22, thus creating frictional forces that cause the rotation of the roll 56 to slow down or to come to a complete stop. The braking mechanism is activated by wrapping the thumb and forefinger around the recessed portion 36 and squeezing inwardly on the recessed portion 36, or by pressing inwardly on selectable locations along the recessed portion 36 using only a portion of the thumb and forefinger. By slowing the rotational motion of the roll 56, the user varies the tension applied to the stock material 28. Consequently, the user controls the amount of tension applied on the stock material 28 as the film 28 is being dispensed.

Upon stopping the rotation of the roll 56, the user can easily sever the unwound stock material 28 from the roll 56. Again, the user stops the rotation of the roll 56, by firmly pressing the recessed portion 36 into the groove 30. Severing the stock material occurs by stopping the rotation of the roll 56 and continuing to move the tool 10 away from the unwound film 28, causing the film 28 to stretch, deform and eventually separate from the roll 56 or by cutting or tearing the stock material.

The invention provides a tool for dispensing a web of stretch film whereby the operator can apply a controlled braking force to the hand grip when the gripper and cylindrical sleeve are mounted on the shaft, creating a braking mechanism that slows or stops the rotation of the shaft and at the same time can apply a differential pressure to the roll to firmly hold the roll as strongly as necessary.

The disclosed embodiment has been provided to illustrate the invention. There are a variety of configurations that may be employed to fabricate the web dispensing tool 10. Therefore, the disclosed embodiment is not intended to limit the scope and spirit of the invention. Consequently, the invention should be limited only by the appended claims.

I claim:

1. A tool for manually dispensing and applying a web of elongated flexible stock material from a roll of the stock material having a shaft that supports the roll and extends beyond the end of the roll, the tool comprising:

a flexible gripper including a cylindrically shaped body defining an open center, an open upper end and a closed lower end, and a relatively rigid cylindrical sleeve having a hollow center received in the open center and positioned in a lower portion of the gripper said sleeve adapted to be supported on the shaft for relatively frictionless rotation and having a length less than the length of the gripper, thereby defining a braking portion on the gripper body between the upper end of the sleeve and the upper end of the gripper, the braking portion directly engageable with the shaft, and further defining a bearing portion on the gripper below the braking portion along the length of the sleeve;

whereby one can compress the braking portion of the gripper inwardly onto the shaft with a thumb and forefinger when the gripper and cylindrical sleeve are mounted on the shaft to provide braking friction to the shaft while at the same time applying a firm, tight grip with the palm of the hand and other fingers to the bearing portion of the gripper without affecting the frictional resistance between the sleeve and the shaft.

2. The tool as defined in claim 1, wherein the sleeve is fabricated from one of a rigid plastic material and paperboard.

3. The tool as defined in claim 2, wherein the sleeve is fabricated of PVC.

4. The tool as defined in claim 1, wherein the braking portion of the gripper includes a recessed portion for aiding the inward compression of the braking portion of the gripper.

5. The tool as defined in claim 1, wherein the braking portion of the gripper includes an annular ridge for retarding axial movement of the sleeve within the open center.

6. Thc tool as defined in claim 1, wherein the gripper includes axially extending ridges on an inner surface thereof for retarding rotational movement of the sleeve with respect to the gripper.

7. The tool as defined in claim 1, wherein the gripper is molded from one of a pliable plastic and paperboard.

8. The tool as defined in claim 7, wherein the gripper is fabricated of PVC.

9. A tool for dispensing and applying a web of a flexible stock material from a roll of the stock material, the tool comprising:

an elongated shaft for supporting the flexible stock material;

a flexible gripper including a cylindrically shaped body defining an open center, an open upper end and a closed lower end;

a relatively rigid cylindrical sleeve having a hollow center received in the open center of the flexible gripper and supported on the shaft for relatively frictionless rotation, the sleeve having a length less than the length of the gripper, thereby defining a braking portion on the gripper body between the upper end of the sleeve and the upper end of the gripper, the braking portion directly engageable with the shaft, and further defining a bearing portion on the gripper below the braking portion along the length of the sleeve; and whereby one can compress the braking portion of the gripper inwardly with a thumb and forefinger onto the shaft when the shaft is received in the hollow center and the cylindrical sleeve is received by the gripper to provide braking friction on the shaft while at the same time applying a firm, tight grip with the palm of the palm of the hand and other fingers to the bearing portion of the gripper without affecting the frictional resistance between the sleeve and the shaft.

10. The tool as defined in claim 9, wherein the sleeve is fabricated from one of a plastic material and paperboard.

11. The tool as defined in claim 10, wherein the sleeve is fabricated of PVC.

12. The tool as defined in claim 9, wherein the braking portion of the gripper includes a recessed surface for aiding the inward compression of the braking portion of the gripper.

13. The tool as defined in claim 12, wherein the shaft defines a groove for receiving the recessed surface, whereby one can compress the recessed surface into the groove to slow or stop the rotation of the shaft.

14. The tool as defined in claim 9, wherein the braking portion of the gripper includes an annular ridge for retarding the axial movement of the sleeve within the open center.

15. The tool as defined in claim 9, wherein the bearing portion of the gripper includes axially extending ridges for retarding the rotational movement of the sleeve within the open center.

16. The tool as defined in claim 9, wherein the gripper is fabricated from one of a soft molded plastic and paperboard.

17. The tool as defined in claim 16, wherein the gripper is fabricated of PVC.

18. A roll of stock material and a gripper assembly for a tool for manually dispensing and applying a web of elongated flexible stock material from a roll of the stock, the assembly comprising:

a roll of stock material supported on an elongated shaft which extends beyond the end of the roll;

a flexible gripper including a cylindrically shaped body defining an open center, an open upper end and a closed lower end mounted on the elongated shaft adjacent the roll of stock material, and a relatively rigid cylindrical sleeve received in the open center of the gripper, having a length less than the length of the gripper and mounted on the shaft spaced from the roll of stock material for relatively frictionless rotation on the shaft, wherein the sleeve defines a braking, portion on a portion of the gripper body between an upper end of the sleeve and the open upper end of the gripper, the braking portion directly engageable with the shaft, wherein one can compress the braking portion of the gripper inwardly onto the shaft with a thumb and forefinger and the cylindrical sleeve is received by the gripper to provide braking friction on the shaft, and wherein the sleeve defines a bearing portion on the gripper below the braking portion along the length of the sleeve wherein one can apply a firm, tight trip to the bearing portion with the palm of the hand and other fingers without affecting the frictional resistance between the sleeve and the shaft.

19. The assembly as defined in claim 18, wherein the braking portion of the gripper includes an annular ridge for retarding the axial movement of the sleeve within the open center.

20. The assembly as defined in claim 18, wherein the bearing portion of the gripper includes axially extending ridges for retarding the rotational movement of the sleeve within the open center.

* * * * *